United States Patent [19]

Benseler et al.

[11] 4,083,125

[45] Apr. 11, 1978

[54] OUTER SOLE FOR SHOE ESPECIALLY SPORT SHOES AS WELL AS SHOES PROVIDED WITH SUCH OUTER SOLE

[75] Inventors: Hans Benseler, Harkenbleck-Hannover; Horst Schaefer, Bad Windsheim, both of Germany

[73] Assignee: PUMA-Sportschuhfabriken Rudolf Dassler KG, Germany

[21] Appl. No.: 693,956

[22] Filed: Jun. 8, 1976

[30] Foreign Application Priority Data

| | | |
|---|---|---|
| Jun. 9, 1975 | Germany | 2525613 |
| Jun. 9, 1975 | Germany | 2525615 |
| Jun. 9, 1975 | Germany | 2525665 |

[51] Int. Cl.[2] ..... A43B 13/0

[52] U.S. Cl. ..... 36/32 R; 36/59 C

[58] Field of Search ..... 36/32 R, 59 C, 25 R

[56] References Cited

U.S. PATENT DOCUMENTS

| | | | |
|---|---|---|---|
| 1,777,558 | 10/1930 | Freeman | 36/32 R X |
| 2,553,616 | 5/1951 | Walls | 36/32 R X |

FOREIGN PATENT DOCUMENTS

| | | | |
|---|---|---|---|
| 189,542 | 4/1957 | Austria | 36/32 R |
| 931,819 | 8/1955 | Germany | 36/32 R |
| 483,600 | 8/1953 | Italy | 36/32 R |
| 501,770 | 11/1954 | Italy | 36/32 R |
| 265,832 | 3/1950 | Switzerland | 36/59 C |
| 138,195 | 2/1920 | United Kingdom | 36/32 R |

*Primary Examiner*—Alfred R. Guest

*Attorney, Agent, or Firm*—Craig & Antonelli

[57] ABSTRACT

A profiled outer sole for shoes, especially sport shoes, made in a mold and consisting of rubber or other material having rubber-elastic properties, which is provided with profiled projections laterally delimiting the tread surface of the outer sole; the profiled projections, in turn, are provided with groove-shaped slots extending obliquely to the respective tangential plane tangential to the outer boundary surfaces of the individual profiled projections within the bisecting plane thereof.

40 Claims, 9 Drawing Figures

OUTER SOLE FOR SHOE ESPECIALLY SPORT SHOES AS WELL AS SHOES PROVIDED WITH SUCH OUTER SOLE

The present invention relates to a profiled outer sole made in a mold for shoes, especially for sport shoes, of rubber or of another material with rubber-elastic properties, especially of synthetic resinous material, with block-shaped or post-shaped profiled projections arranged along the lateral sole edges.

It is known in connection with ski-, mountain- or hiking boots to provide the lateral sole edges of the outer sole with block- or post-shaped profiled projections arranged in one or several rows. The distance between the individual profiled projections is thereby approximately as large as the width thereof.

This prior art outer sole offers a sufficient gripping ability and non-slip stability in case of a relatively soft underground. However, it is not possible with these outer soles having post- or block-profile rows, to make the blocks so small or the rows of blocks so fine in structure that the slipping safety is assured to a sufficient extent not only with a relatively soft underground but also with a relatively harder underground.

The present invention is concerned with the task to so construct an outer sole of the aforementioned type that this outer sole exhibits excellent non-slipping and standing characteristics for the user.

The underlying problems are solved according to the present invention in that the block-shaped or post-shaped profiled projections laterally delimiting the tread surface of the outer sole are provided with groove-shaped slots extending obliquely to the respective tangential plane tangential to the outer boundary surfaces of the individual profiled projections in the bisecting plane thereof.

The deformability and the number of gripping edges of the block- or post-shaped profiled projections is increased by the groove-shaped slots. The block- or post-shaped profiled projections or raised portions are therewith also able to adapt themselves readily to small unevennesses of the ground and to produce the desired frictional connection.

It is of advantage if each of the block- or post-shaped profiled projections includes two or more mutually parallel groove-shaped slots and if possible the groove-shaped slots are constructed V-shaped or roof-shaped with the flanks thereof being open in the direction toward the sole longitudinal axis. The gripping and slipping safety of the outer sole according to the present invention is still further improved in case of longitudinal and cross loads by the inclined position or roof-shaped construction of several groove-shaped slots.

The outer sole according to the present invention may be constructed with advantage in such a manner that it possesses, in addition to a high non-slipping characteristic, an excellent standing ability also with a hard and/or smooth underground such as with hall floors of wood, synthetic plastic material, asphalt, concrete or the like. It is of advantage in connection therewith if the outer or tread surface edges of the outer sole which extend essentially parallel to the sole longitudinal axis, are formed by extensions which project with respect to the lateral surfaces of the outer sole.

The lateral extensions of the outer sole according to the present invention which form the tread surface edges, lead to an increase of the lateral contours of the outer sole, which is preferably shell-shaped in cross section. As a result thereof, one obtains a considerably increased tread surface in comparison to the prior art profiled outer soles and therewith an improved slipping stability, which is of importance especially for tread soles of such sport shoes, which are used in hall-types of sports or in types of sports in other sport facilities and places with a comparatively hard and frequently also smooth ground.

The lateral extensions forming the tread surface edges extend with advantage beyond the sole longitudinal sides with the exception of the strongly rounded-off forward and rear outer sole ends. It is assured therewith that the aforedescribed advantages of the outer sole according to the present invention become fully effective without the fact that the technical measures necessary therefor lead to an impairment with the intended use of a shoe, especially of a sport shoe, having an outer sole according to the present invention.

The present invention also relates to a shoe, especially to a sport shoe, with a profiled outer sole constructed as molded body and made of rubber or of another material with rubber-elastic properties, especially of synthetic resinous material, having block-shaped or post-shaped profiled projections or raised portions arranged along the lateral sole edges. Such a shoe, especially a sport shoe should excel in that in addition to the aforementioned properties, namely a high non-slipping characteristic and stability during the walking, running or jump movements of its wearer, it possesses an agreeably soft, spring-elastic step and in that therebeyond an intensive inner venting is achieved therebeyond with such shoe. It is thereby of advantage if the block- or post-shaped profiled projections laterally delimiting the outer or tread surface of the outer sole are provided with groove-shaped slots extending at an inclination to the respective tangential plane tangential at the outer boundary surfaces of the individual profiled projections in the bisecting plane thereof, if the outer sole is provided within the area of the forward sole and possibly also of the rear sole with (inner) profiled projections surrounded by the block- or post-shaped profiled projections and having hollow spaces open in the direction toward the inner sole, if in the unloaded condition of the outer sole the inner profiled projections project with respect to the tread surface formed by the edge profiling and if the inner sole covering the hollow spaces of the profiled projections is air-permeable.

The edge profiling surrounding the inner profiled projections which, on the one hand, is form-stable and, on the other, is nonetheless yielding or elastic to a sufficient extent, assures the necessary frictional connection by means of the tread surface and therewith assures the necessary non-slipping characteristics and standing ability both in case of longitudinal as also cross loads of the shoe according to the present invention, especially of the sport shoe. The inner profiled projections provided with hollow spaces open toward the inner sole condition the springy step, which by reason of their projection in relation to the outer or tread surface formed by the edge profiling, produce an intensive pumping action by the alternate reduction and increase of the hollow spaces coupled therewith, which permits the inflow into and outflow of the air from the shoe and therewith leads to an intensive internal ventilation of the shoe.

In that connection, it is particularly advantageous if the apertures or openings of the insole and of the cover sole have a considerably smaller cross section than the hollow spaces of the profiled projections. A type of throttle effect results from the comparatively smaller cross section of the apertures of the insole and of the cover sole, which assures the spring elastic step and at the same time assures a sufficient ventilation of the interior of the shoe.

These and further objects, features and advantages of the present invention will become more apparent from the following description when taken in connection with the accompanying drawing which shows, for purposes of illustration only, several embodiments in accordance with the present invention, and wherein.

Figure 1:
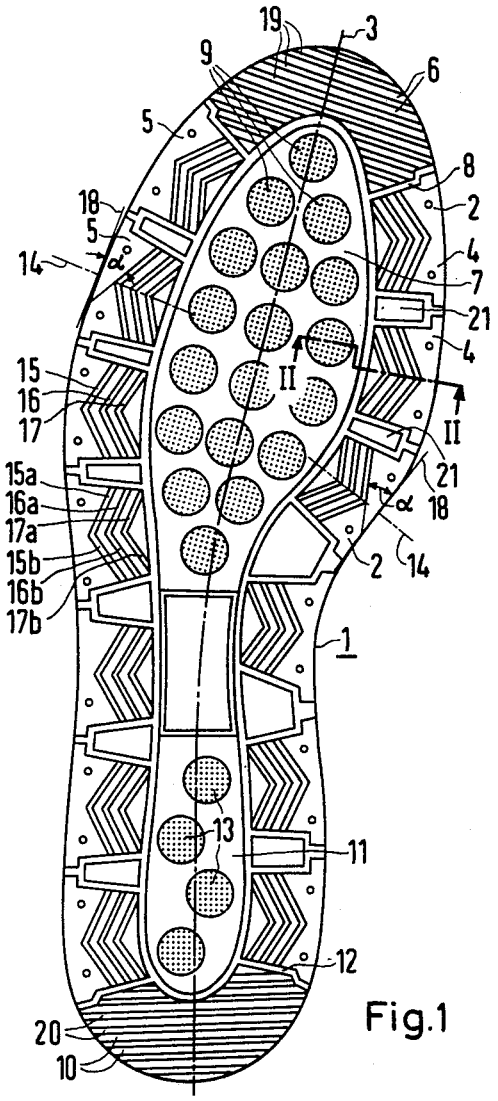
FIG. 1 is a plan view on an outer sole for a sport shoe according to the present invention.
Figure 2:
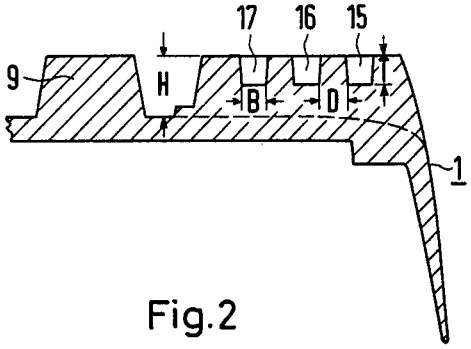
FIG. 2 is a partial cross-sectional view taken along line II—II in FIG. 1.

Referring now to the drawing wherein like reference numerals are used throughout the various views to designate like parts, and more particularly to FIGS. 1 and 2, the sole body made in one piece and preferably constructed shell-shaped consists of a material with rubber-elastic properties such as natural or synthetic rubber, synthetic resinous material made rubber-elastic by the addition of suitable hardeners, preferably on the basis of polyurethane, epoxy resins or the like. The sole body includes at its two lateral edges block-shaped or post-shaped profiled projections or raised portions 2 laterally delimiting the outer or tread surface of the outer sole 1, which are arranged one behind the other in the direction of the sole longitudinal axis 3 and thus form block rows 4 and 5. The outer sole 1 is closed off forwardly by a ring-segmentally shaped profiled projection 6. The block or post-shaped profiled projections 2 and the ring-segmentally-shaped profiled projection 6 enclose in the center portion 7 of the forward sole 8, profiled projections or raised portions 9 of cylindrical or truncated conical shape with a smaller effective tread surface than the surface of the profiled projections 2, 6 surrounding the same.

Toward the rear, the outer sole 1 is closed off by an also ring-segmentally shaped profile projection 10. The block-shaped or post-shaped profiled projections 2 and the ring-segmentally-shaped profiled projection 10 surround in the center portion 11 of the rear sole 12, cylindrical or conically truncated profiled projections 13 with an also smaller effective tread surface than the surface of the profiled projections 2, 10 surrounding the same.

The block- or post-shaped profiled projections 2 have an approximately trapezoidally shaped configuration in plan view and more particularly in such a manner that the longer of the two mutually parallel sides forms the edge of the sole tread surface.

Three mutually parallel groove-shaped slots 15, 16 and 17 are provided symmetrically to the bisecting planes 14 of the block- or post-shaped profiled projections 2 extending perpendicularly to the sole longitudinal axis 3, which are constructed roof-shaped or V-shaped and with flanks 15*a*, 15*b*, 16*a*, 16*b* and 17*a*, 17*b* opening toward the sole longitudinal axis 3. The groove-shaped slots 15, 16 and 17 are preferably arranged nested one within the other. The flanks of the groove-shaped slots 15, 16 and 17 subtend with respect to the respective tangential plane 18 tangential the outer boundary surfaces of the individual profiled projections 2 in the bisecting plane 14 thereof, an angle $\alpha$ of about 20° to about 40°, preferably of about 30°. The groove-shaped slots 15, 16 and 17 have preferably a width B of about 1 to about 2 mm. and a depth T (FIG. 2), which corresponds approximately to half the height H of the block or post-shaped profiled projections 2. The mutual spacing D of the groove-shaped slots 15, 16 and 17 corresponds advantageously approximately to the width B of such a slot 15, 16 and 17.

For purposes of further improving the non-slip characteristics under loads in the sole longitudinal direction, the ring-segmentally-shaped profiled projections 6 and 10 are provided with groove-shaped slots 19 and 20 extending at least approximately perpendicularly to the sole longitudinal axis 3.

Profiled projections 21 are provided with advantage between the block-shaped or post-shaped profiled projections 2 separated from one another by more or less large intermediate spaces, which profiled projections 21 have a smooth surface. The profile depth of these profiled projections 21 corresponds approximately to that of the profiled projections 2. However, the dimensions of the profiled projections 21, especially the width thereof, are smaller, and within the area of the forward sole 8 are even considerably smaller than those of the profiled projections 2.

However, more or fewer than three groove-shaped slots may also be provided in each block or post-shaped projection 2 without departing from the scope of the inventive concept. In lieu of a roof or V-shaped profiling, also a zig-zag shaped profiling may be provided, especially with larger profile widths. The profiled projections 13 in the center portion 11 of the rear sole 12 may possibly be profiled in a different manner than the profiled projections 9 in the center portion 7 of the forward sole 8.

The obliquely extending groove-shaped slots 15, 16 and 17 in the profiled projections 2 lead to an increased elastic deformability of the block- or post-shaped profiled projections 2. One obtains therewith an excellent standing and slipping stability of the outer sole according to the present invention both under loads in the sole longitudinal direction as also in the sole transverse direction with a comparatively coarse distribution of the sole edges which is desirable with a view toward the mold costs. The profiled projections 8 and 13 of cylindrical or conically truncated shape in the center portion 7 of the forward sole 8 and possibly also in the center portion 11 of the rear sole 12 additionally assist this effect by their construction and configuration and by their arrangement essentially symmetrical to the longitudinal axis 3 of the sole.

The outer sole may be constructed, as illustrated and described, as shell sole with a laterally circumferential shell edge. However, the present invention can be applied with equal advantage also to flat soles without circumferential shell edge.

Figure 3:
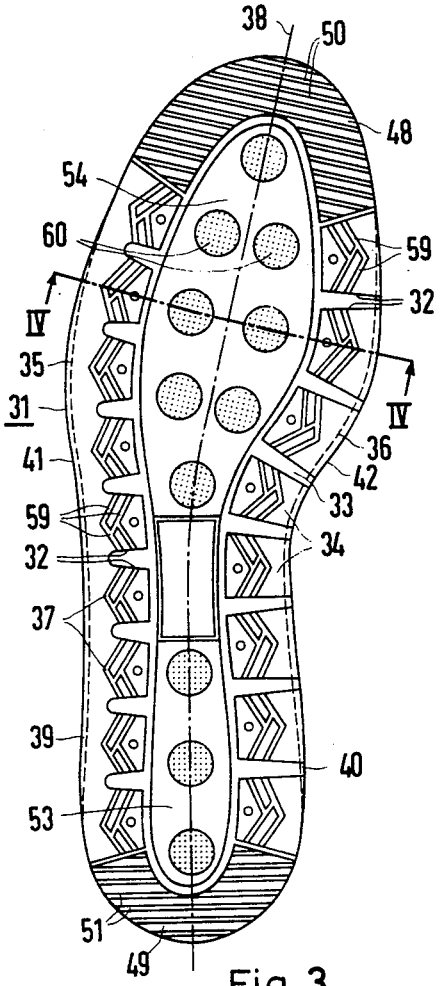
FIG. 3 is a plan view on the outer or tread surface of a modified embodiment of an outer sole which is particularly suited for hall-type sports.
Figure 5:
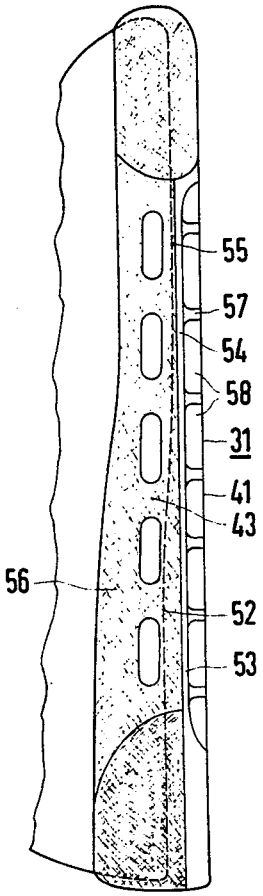
FIG. 5 is a side elevational view of the outer sole according to FIG. 3.
Figure 4:
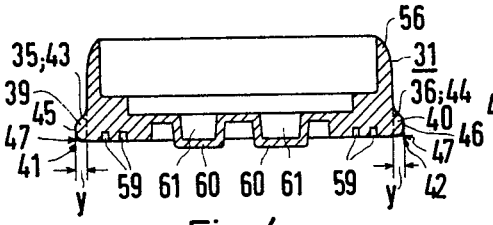
FIG. 4 is a cross-sectional view through the outer sole according to FIG. 3, taken along line IV—IV, and more particularly with an upwardly directed inner surface of the sole.

As illustrated in FIGS. 3 to 5, the outer sole 31 according to the present invention may also be so constructed that the edge profiling 32 is formed by block-shaped or post-shaped profiled projections 34 separated by groove-shaped recesses or slots 33 or is formed by profiled projections 37 preferably connected with each other band-shaped at the outer sole edges 35 and 36. For purposes of increasing the tread surface, the profiled projections 34 and 37 are enlarged at the outer sole edge 35 and 36 by extensions 39 and 40 (FIGS. 3 and 4) extending essentially parallel to the sole longitudinal axis 38, whereby the tread surface edges 41 and 42 formed by the lateral extensions 39 and 40 project by a predetermined amount $y$ with respect to the outer sole edges 35 and 36, properly speaking, or with respect to the lateral surfaces 43 and 44 of the outer sole 31.

The lateral extensions 39 and 40 at the lateral surfaces 43 and 44 of the outer sole 31 are constructed as rounded-off shoulders 45 and 46 which extend from the plane of the outer or tread surface 47 formed by the profiled projections 34 and 37 bead-shaped in the upward direction toward the lateral surfaces 43 and 44 of the outer sole 31. The projecting length $y$ formed by the lateral extensions 39 and 40 may amount to about 2 to about 5 mm. depending on the sole size and intended use of the outer sole 31. As a result thereof, one obtains a greater or lesser enlargement of the width of the outer or tread surface 47, which becomes favorable as regards the standing ability of the wearer of such a shoe, especially of a sport shoe.

The lateral extensions 39 and 40 forming the outer tread surface edges 41 and 42 extend advantageously beyond the longitudinal sides of the sole or the tread sole edges 35 and 36 with the exception of the strongly rounded-off forward and rearward outer sole ends 48 and 49 which are provided preferably as U-shaped or circular segmentally shaped profiled projections with groove-shaped slots 50 and 51 extending at least approximately perpendicularly to the sole longitudinal axis.

The inner surface of the outer sole 31 may, as known as such, be constructed wedge-shaped in longitudinal cross section, whereby the wedge 52 (FIG. 5) at first extends flat in the first portion of the rear sole 53 as viewed from the sole end and then later on tapers continuously in the direction toward the forward sole 54. With such a wedge sole, the shoulders 45 and 46 forming the lateral extensions 39 and 40 are extended up preferably only within the area of the forward sole 54 approximately up to the inner surface 55 of the outer sole 31.

Figure 6:
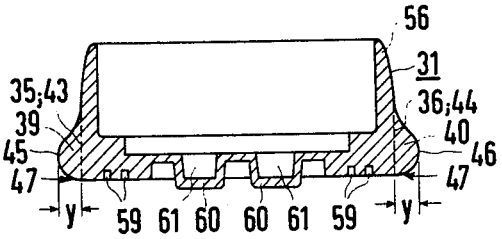
FIG. 6 is a cross-sectional view through a further modified embodiment of an outer sole according to the present invention.

In case a particularly high lateral stability and a high non-slipping characteristic is desirable when the athlete or wearer of the shoe steps or treads on the edge of the shoe, it is of advantage if the shoulders 45 and 46 forming the lateral extensions 39 and 40 are drawn up at least within the area of the flat forward sole 54 over the inner surface 55 of the outer sole 31 and especially additionally engage a part of the drawn-up shell edge 56, in case the outer sole 31 is constructed as known and frequently used shell sole. A corresponding construction of the present invention is illustrated in FIG. 6.

The lateral extensions 39 and 40 of the outer sole 31 may be constructed as continuous shoulder band as this is schematically indicated in FIG. 3 in dash line. The aforementioned lateral stability, however, is still further increased if the lateral extensions 39 and 40 of the outer sole 31 are constructed as shoulder pieces 58 (FIG. 5) interrupted by gaps 57.

For a further improvement of the non-slipping characteristic of the outer sole 31 according to the present invention, it is of advantage if the block-shaped or post-shaped profiled projections 34 or the profiled projections 37 connected with each other band-shaped at their outer edge are provided with groove-shaped slots 59 extending obliquely to the sole longitudinal axis 38. If therebeyond also a marked spring-elastic step is desired, it is of advantage if the lateral edge profiling 32 surrounds inner profiled projections 60 constructed as round or strip profiles and having hollow spaces 61 open in the direction toward the inner sole. These inner profiled projections 60 possess elastically yielding side walls and project slightly with respect to the outer or tread surface 47 formed by the edge profiling 32, as a result of which the spring-elastic step is assured.

The outer sole according to the present invention possesses in particular with its use for hall types of sports excellent properties, namely a high non-slipping characteristic, and a high lateral stability when landing on the sole edges or in case of other strong sole cross loads. The cushion effect of the outer sole according to the present invention which exists by reason of the spring-elastic inner profiled projections 60 is also very desirable, especially in hall types of sports with frequent jump throws as in hand ball or basketball.

According to a further development of the present invention, the outer sole, as illustrated in plan view in FIG. 1, may also be so constructed that the inner profiled projections 73 surrounded by the edge profiling 72 in the center portion of the forward sole (FIGS. 7 and 8) and possibly also the inner projections 74 and 75 in the center portion of the rear sole are constructed as knub-shaped round or elongated profiles. The inner profiled projections 73, 74 and 75 are provided with hollow spaces 77 open in the direction toward the inner sole 76. The inner profile projections 73, 74 and 75 project in the unloaded condition of the outer sole 71 by the distance $a$ with respect to the outer or tread surface 78 formed by the edge profiling 72. The projecting length $a$ of the inner profiled projections 73, 74 and 75 with respect to the tread surface 78 of the edge profiling 72 corresponds with advantage approximately to the profile wall thickness $x$ provided in the outer or tread surface of the inner profiled projections 73, 74 and 75.

By reason of the projection $a$ of the inner profiled projections 73, 74 and 75, the latter are compressed and subsequently again expanded during walking, running or jumping with the sport shoe according to the present invention, corresponding to the loading and unloading of the outer sole by elastic deformation. As a result of the alternate decrease and increase of the hollow spaces 77 formed by the inner profiled projections 73, 74 and 75, a pumping action results which permits the air to flow in and out of the shoe and which effects an effective, intensive internal ventilation of the shoe.

Figure 8:
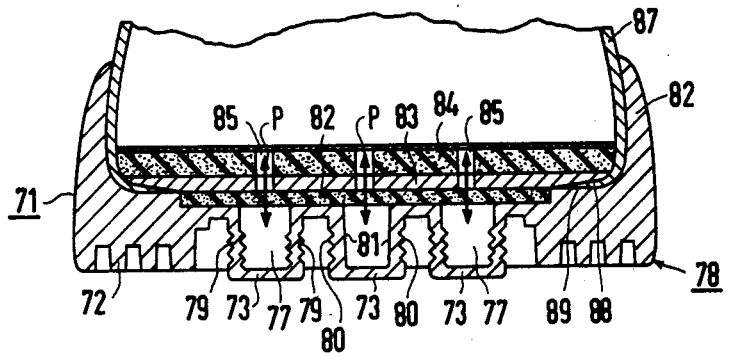
FIG. 8 is a cross-sectional view through an outer sole with an inner sole according to the present invention and having inner profiled projections modified as compared to the embodiment of FIG. 7.

This pumping action can be further enhanced in that the inner profiled projections 73, 74 and 75 are provided with side walls 79 movable in the manner of a bellows, as illustrated in FIG. 8. With a relatively soft sole material, it may additionally be of advantage if only the outer surface 80 of the lateral walls 79 of the inner profiled projections 73, 74 and 75 are provided with a bellows profile whereas the inner surfaces 81 of the side walls 79 extend smoothly. The profiled projections 73, 74 and 75 may, however, also include in principle a hollow profile without outer and/or inner bellows folds.

Figure 7:
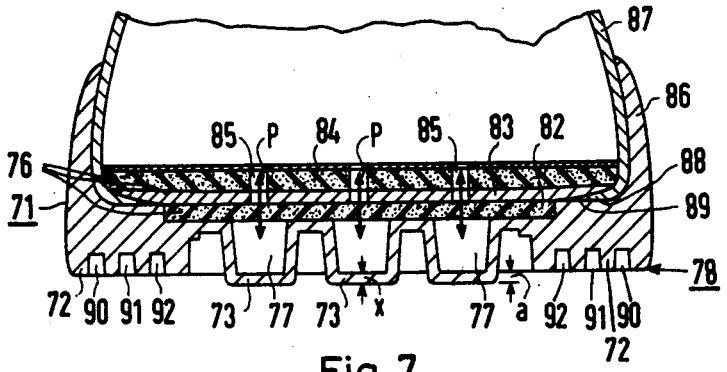
FIG. 7 is a cross-sectional view through a modified embodiment of an outer sole with an inner sole in accordance with the present invention and having inner profiled projections which are provided with hollow spaces open in the direction toward the inner sole.

As shown in FIGS. 7 and 8, the inner sole 76 of the sport shoe consists of several layers, namely, of a compensating sole 82, of an welt 83 and of a cover sole 84. The compensating sole 82 consists of a porous material compressible in its volume such as rubber or synthetic resinous foamed material, sponge rubber, rubber hair or the like. The air-permeable compensating sole 82 rests therefore directly on the outer sole 71 and covers the center portions of the front and rear sole provided with the inner profiled projections 73, 74 and 75 and additionally with the hollow spaces 77. The welt 83 provided with apertures 85 follows the compensating sole 82. The apertures 85 are at least in part aligned with the hollow spaces 77 of the inner profiled projections 73, 74 and 75. However, it is recommended to provide more apertures 85 than profiled projections 73, 74 and 75 or hollow spaces 77. The cover sole 84 covering the welt 83 may also be provided with apertures. However, the cover sole 84 may also be made of air-permeable material such as sponge rubber with a fabric closing off toward the foot inside. A part of the upper 87 of leather is illustrated between the inner sole 76 and the shell-shaped edge 86 of the outer sole 71, whose wrapping 88 is attached to or adhesively fastened at the freely exposed inner edge 89 of the outer sole 71.

The apertures 85 in the inner sole 86 have a considerably smaller cross section than the hollow spaces 77 of the profiled projections 73, 74 and 75. A type of throttle action results therefrom which assures the spring-elastic step of the sport shoe with the outer sole according to the present invention and at the same time guarantees a sufficient ventilation of the shoe inside.

Figure 9:
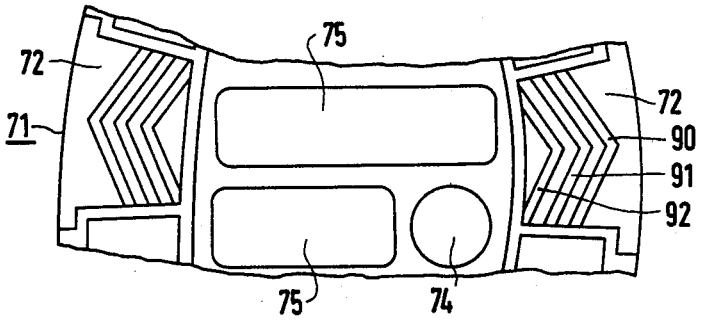
FIG. 9 is a partial plan view on a further embodiment of an outer sole in accordance with the present invention.

As shown in FIG. 9, the inner profiled projections may be constructed at least in part also as rounded-off strip profiles. The strip profiles 75 may extend over the entire center portion of the front sole and/or over the entire center portion of the rear sole. However, also combinations of strip profiles 75 with round profiles 74 are possible as can be seen from FIG. 9. Of course, also other geometric forms of the inner profiled projections 73, 74 and 75 and the combinations thereof are possible with each other.

The edge profiling 72 may, as described in conjunction with the embodiment according to FIG. 1, be provided with groove-shaped slots 90, 91 and 92 which extend obliquely to the sole longitudinal axis, as shown in FIG. 9.

As shown by the embodiment described hereinabove, a strong deformation of the elastic inner profiled projections 73, 74 and 75 takes place by the walking or running movement. A pumping action results therefrom which brings about an air circulation in the direction of the double arrows P (FIGS. 7 and 8). The inner profiled projections 73, 74 and 75 which project by a certain distance beyond the outer or tread surface 78 of the edge profiling 72, thereby serve as pump elements. The profiled projections 73, 74 and 75 assure therebeyond also a spring-elastic step of the athlete or wearer of the shoe which is very desirable especially with hard floors such as with floors of halls. The inner ventilation of the shoe, especially of the sport shoe, can be further enhanced in that air inlet openings are provided in the lower portion of the upper of the shoe or sport shoe which are in communication with the hollow spaces of the inner profiled projections. In order to prevent the penetration of water and/or of dirt, the air inlet openings in the lower part of the upper may be covered off with a cover strip provided with apertures open in the upward direction.

The outer sole according to the present invention may, as illustrated and described, be constructed as shell sole with a lateral circumferential shell edge. However, the present invention can be applied with equal advantage also to flat soles without circumferential shell edge. The outer sole according to the present invention represents a universal sole with numerous possibilities of use. It is suited for all types of sports as also for types of sports on the outside, and more particularly for cinder tracks as also for plastic tracks or places.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. A profiled outer sole for shoes made of a material having rubber-elastic properties, and provided with profiled projection means arranged along lateral sole edges, characterized in that the profiled projection means laterally delimit a tread surface of the outer sole, each of the profiled projection means are provided with at least two V-shaped slots opening in a direction toward a longitudinal axis of the sole and extending obliquely to a tangential plane at outer boundary surfaces of the individual profiled projection means in a bisecting plane thereof, said at least two V-shaped slots are nested one within the other.

2. An outer sole according to claim 1, characterized in that the outer sole is a molded sole.

3. An outer sole according to claim 2, characterized in that the V-shaped slots are arranged at least approximately symmetrically to the respective bisecting plane of the individual profiled projection means extending substantially perpendicularly to a longitudinal axis of the sole.

4. An outer sole according to claim 1, characterized in that the outer sole is for sports shoes.

5. An outer sole according to claim 1, characterized in that the outer sole is made from a material selected from the group consisting of rubber and synthetic resinous materials.

6. An outer sole according to claim 1, characterized in that the profiled projection means are approximately block-shaped.

7. An outer sole according to claim 1, characterized in that the V-shaped slots are arranged at least approximately symmetrically to the respective bisecting plane of the individual profiled projection means extending substantially perpendicularly to the sole longitudinal axis.

8. An outer sole according to claim 7, characterized in that the V-shaped slots subtend an angle of about 20° to about 40° with the tangential plane at the outer boundary surface of the respective profiled projection means.

9. An outer sole according to claim 8, characterized in that the V-shaped slots have a width of about 1 to 2 mm. and a depth which corresponds to approximately half a height of the profiled projection means.

10. An outer sole according to claim 9, characterized in that a mutual spacing of adjacent V-shaped slots corresponds approximately to a width of such a slot.

11. An outer sole according to claim 8, characterized in that the V-shaped slots subtend an angle of about 30° with a tangential plane at the outer boundary surface of the respective profiled projection means.

12. An outer sole according to claim 8, characterized in that the V-shaped slots subtend an angle of about 20° to about 40° with the tangential plane at the outer boundary surface of the respective profiled projection means.

13. An outer sole according to claim 8, characterized in that the V-shaped slots have a width of about 1 to 2 mm. and a depth which corresponds to approximately half a height of the profiled projection means.

14. An outer sole according to claim 8, characterized in that a mutual spacing of adjacent groove-shaped slots corresponds approximately to a width of such a slot.

15. An outer sole according to claim 8, characterized in that rows of profiled projection means are disposed at both lateral sole edges and are connected with each other by segmentally-shaped profiled projections.

16. An outer sole according to claim 15, characterized in that the segmentally shaped profiled projections are provided with groove-shaped slots extending at least approximately perpendicularly to the sole longitudinal axis.

17. An outer sole according to claim 1, characterized in that the profiled projection means delimiting a front of the sole and associated segmentally shaped profiled projections surround inner profiled projections with smaller effective tread surface than a surface of the profiled projection means surrounding the same.

18. An outer sole according to claim 17, characterized in that the inner profiled projections are knub shaped.

19. An outer sole according to claim 1, characterized in that the segmentally shaped profiled projection means delimiting a rear of the sole and associated segmentally shaped profiled projections surround profile projections with smaller effective tread surface than a surface of the profiled projection means surrounding the same.

20. An outer sole according to claim 19, characterized in that the inner profiled projections are knub-shaped.

21. An outer sole according to claim 1, characterized in that edges of the tread surface of the outer sole extend essentially parallel to the sole longitudinal axis and are formed by extensions which project with respect to the lateral surfaces of the outer sole.

22. An outer sole according to claim 21, characterized in that the lateral extensions extend beyond longitudinal sides of the sole with the exception of a strongly rounded-off forward and rear outer sole ends.

23. An outer sole according to claim 22, characterized in that the lateral extensions are constructed as shoulders rounded-off at the tread surface of the outer sole.

24. An outer sole according to claim 23, characterized in that the shoulders terminate at least within an area of a forward end of the sole in a drawn-up shell edge of an outer sole constructed as shell sole.

25. An outer sole according to claim 23, characterized in that the extensions of the outer sole are constructed as continuous shoulder band.

26. An outer sole according to claim 23, characterized in that the lateral extensions of the outer sole are constructed as shoulder strips interrupted by gaps.

27. An outer sole according to claim 23, characterized in that the lateral extensions continue in the tread surface of the outer sole in block-shaped profiled projection means.

28. An outer sole according to claim 23, characterized in that the extensions continue in the tread surface of the outer sole in profiled projection means connected with each other band-shaped at the edge of the tread surface.

29. An outer sole according to claim 1, characterized in that edges of the tread surface of the outer sole extend essentially parallel to the sole longitudinal axis and are formed by extensions which project with respect to the lateral surfaces of the outer sole.

30. An outer sole according to claim 29, characterized in that the lateral extensions extend beyond longitudinal sides of the sole with a exception of the strongly rounded-off forward and rear outer sole ends.

31. An outer sole according to claim 29, characterized in that the lateral extensions are constructed as shoulders rounded-off at the tread surface of the outer sole.

32. An outer sole according to claim 29, characterized in that the shoulders terminate at least within an area of a forward end of the sole in a drawn-up shell edge of an outer sole constructed as shell sole.

33. An outer sole according to claim 29, characterized in that the extensions of the outer sole are constructed as continuous shoulder band.

34. An outer sole according to claim 29, characterized in that the lateral extensions of the outer sole are constructed as shoulder strips interrupted by gaps.

35. An outer sole according to claim 29, characterized in that the lateral extensions continue in the tread surface of the outer sole in block-shaped profiled projection means.

36. An outer sole according to claim 29, characterized in that the extensions continue in the tread surface of the outer sole in profiled projection means connected with each other band-shaped at the edge of the tread surface.

37. A profiled outer sole for shoes made of a material having rubber-elastic properties, and provided with profiled projection means arranged along lateral sole edges, characterized in that the profiled projection means laterally delimiting a tread surface of the outer sole are provided with groove-shaped slots extending obliquely to a tangential plane at outer boundary surfaces of the individual profiled projection means in a bisecting plane thereof, and in that rows of profiled projection means disposed at both lateral sole edges are connected with each other by segmentally shaped profiled projections.

38. An outer sole according to claim 32, characterized in that the profiled projections are provided with groove-shaped slots extending at least approximately perpendicularly to the sole longitudinal axis.

39. An outer sole according to claim 37, characterized in that the profiled projection means delimiting a front of the sole and associated segmentally shaped profiled projections surround inner profiled projections with smaller effective tread surface than a surface of the profiled projection means surrounding the same.

40. An outer sole according to claim 37, characterized in that the segmentally shaped profiled projection means delimiting a rear of the sole and associated segmentally shaped profiled projections surround profile projections with smaller effective tread surface than a surface of the profiled projection means surrounding the same.

* * * * *